US009492701B1

(12) United States Patent
Bognatz

(10) Patent No.: US 9,492,701 B1
(45) Date of Patent: Nov. 15, 2016

(54) DUMBBELL POWER RACK APPARATUS

(71) Applicant: Don Bognatz, San Diego, CA (US)

(72) Inventor: Don Bognatz, San Diego, CA (US)

(73) Assignee: Don Bognatz, San Diego, CA (US)

( * ) Notice: Subject to any disclaimer, the term of this patent is extended or adjusted under 35 U.S.C. 154(b) by 0 days.

(21) Appl. No.: 13/777,940

(22) Filed: Feb. 26, 2013

(51) Int. Cl.
*A63B 21/078* (2006.01)
*A63B 21/072* (2006.01)

(52) U.S. Cl.
CPC ..... *A63B 21/072* (2013.01); *A63B 21/078* (2013.01)

(58) Field of Classification Search
CPC ..... A63B 21/072; A63B 21/00047; A63B 21/062; A63B 21/0622; A63B 21/0624; A63B 21/0626; A63B 21/0628; A63B 21/4029; A63B 21/4031; A63B 27/078; A63B 21/078; A63B 21/0783; A63B 21/16; A47B 57/48; A47B 57/482; A47B 57/487; A47B 57/50; A47B 57/52; A47B 57/40; A47B 57/42; A47B 57/44; A47B 57/46; A47B 96/14; A47B 96/1408; A47B 96/1433
USPC ..... 482/104, 92–94; 211/85.7, 191, 192, 211/187, 190; 248/520, 538, 222.51, 248/224.51; D21/680, 681, 682, 686, 690, D21/691
See application file for complete search history.

(56) References Cited

U.S. PATENT DOCUMENTS 2,890,012 A * 6/1959 Deitch ..... A47B 57/045 248/242
4,826,115 A * 5/1989 Novitski ..... A47B 57/42 248/224.8
4,958,833 A * 9/1990 Stater ..... 482/104
4,973,051 A * 11/1990 Stater ..... A63B 21/078 482/104
4,985,833 A * 1/1991 Oncken ..... G06Q 20/10 705/39
5,350,346 A * 9/1994 Martinez ..... A63B 21/078 482/104

(Continued)

OTHER PUBLICATIONS

Fitness Serve Products and Services, Dumbbell Trays Designed for Power Racks, http://stores.fitnessserve.com/-strse-15440/trays,-dumbell,-for-2.5%22/Detail.bok, Mar. 22, 2013, 2 pages, Fitness Serve, USA.
home-gym-bodybuilding.com, Homemade Power Rack Pins, http://www.home-gym-bodybuilding.com/homemade-power-rack-pins.html, Mar. 22, 2013, 5 pages, E-biz Enterprises LLC.

(Continued)

*Primary Examiner* — Oren Ginsberg
*Assistant Examiner* — Megan Anderson
(74) *Attorney, Agent, or Firm* — San Diego IP Law Group LLP; Trevor Coddington

(57) ABSTRACT

The present invention provides, in at least one embodiment, a power rack apparatus for lifting dumbbells. The apparatus can have a conventional cage design or a novel cage design with dual pull up bars. The apparatus also has novel dumbbell trays configured to attach to a novel horizontal support. The horizontal support is configured to attach to the cage in a plurality of vertical positions and the horizontal support contains a plurality of slots for horizontal width adjustment of the dumbbell trays. The slots on the horizontal support are configured to receive a plurality of inclined dumbbell trays. The apparatus can be a combo power rack configured to hold barbells and dumbbells or a simplified power rack apparatus configured to just hold dumbbells.

19 Claims, 6 Drawing Sheets

(56) References Cited

U.S. PATENT DOCUMENTS

| | | | | |
|---|---|---|---|---|
| 5,924,964 | A * | 7/1999 | Hayden | 482/104 |
| 6,149,556 | A * | 11/2000 | Jordan | 482/104 |
| 7,001,314 | B1 * | 2/2006 | Hummer, Jr. | 482/104 |
| 7,699,756 | B2 * | 4/2010 | Piane, Jr. | 482/38 |
| 7,963,886 | B1 * | 6/2011 | Schwinn et al. | 482/5 |
| 2005/0009671 | A1 * | 1/2005 | Hummer, Jr. | A63B 21/078 482/94 |
| 2007/0049472 | A1 * | 3/2007 | Hummer | A63B 71/0036 482/104 |
| 2007/0099773 | A1 * | 5/2007 | Hummer | A63B 21/078 482/104 |
| 2012/0225756 | A1 * | 9/2012 | Reyes | 482/104 |
| 2012/0329614 | A1 * | 12/2012 | Schiano | 482/104 |

OTHER PUBLICATIONS dumbbell-rack.hezlet.com, Hex Dumbbell Rack, http://dumbbell-rack.hezlet.com/Hex-Dumbbell-Rack.html, Mar. 22, 2013, 1 page.

bodybuilding.com, Dumbbell Trays, http://forum.bodybuilding.com/showthread.php?t=118628831&page=1, Mar. 22, 2013, 13 pages.

Advantage Fitness Products, Star Trac Bench Press, http://www.afproducts.com/products/item/category/benches-and-racks/star-trac-bench-press/, Mar. 22, 2013, 2 pages, Fitness Ventures International, LLC.

Sorinex Exercise Equipment, Bench with Dumbbell Spotter, http://store.sorinex.com/Dumbbell-Spotter-Drop-in-for-bench-Max-Racks-p/dbsdi-1.htm, Mar. 22, 2013, 2 pages, Sorinex Exercise Equipment.

* cited by examiner

DUMBBELL POWER RACK APPARATUS

BACKGROUND OF THE INVENTION

1. Field of Invention

The invention relates generally to weight lifting exercise equipment, and more particularly, to a power rack apparatus for lifting at least heavy dumbbells to failure, without the need for a human spotter.

2. Description of Related Art

A power rack (also known as a power cage, a cage, a squat cage, or a squat rack) is a weight training device designed to allow lifters to use barbell free weights safely without the movement restrictions imposed by a machine, such as a Smith machine. The cage comprises four or six vertical posts with horizontal shelves and horizontal safety bars. The cage has been around for many decades and is well known by weight lifters, from beginners to more seasoned lifters.

The cage is useful for recreational lifting, scholastic lifting, professional strength training, bodybuilding, and power lifting. The cage can be used to perform many exercises targeting the complete upper and lower body muscles. The lifts can be standing, seated upright or inclined on a bench, and lying flat or declined on the bench. Some exercises include many types of barbell bench presses, overhead barbell presses, barbell shrugs, barbell tricep extensions, barbell curls, barbell squats, and barbell dead lifts. The cage can be used to perform a complete full range of motion training, partial repetitions, and static holds.

The cage allows the lifter to place an empty barbell bar in a safe starting position on vertically adjustable barbell shelves based on the lifter's particular body size and the type of exercise that they are performing. Once in position, the bar can be loaded with the desired amount of weight by the lifter before they get into position to begin the lift. Without the shelves, the lifter would put himself at risk of injury as they would have to heave a heavy barbell off the floor and into the starting position of the lift. Getting the barbell to the starting position would often take a very awkward and dangerous movement. Further, the lifter would spend critical energy and strength reserves before they even begin the desired lift. Thus, lifting the barbell to the starting position would detract from his overall performance including the number of repetitions and the amount of weight that can be used on the lift.

A conventional cage has safety bars, which are a main advantage of this lifting equipment over other types of weight racks, because the safety bars allow the lifter to train to failure without the aid of a human spotter. Training to failure allows the lifter to completely exhaust a given muscle in just a few sets and thus allows for entire body workouts in as short as forty five minutes to an hour. This is much quicker, more effective, and results in shorter muscle recovery times than when not training to failure, resulting in more strength and muscle gains in a given year. Just as important, the shorter workouts allow the lifter to spend more time outside of the gym to pursue other interests and activities.

Just before starting the exercises, the lifter sets the safety bars at the desired height such that once failure is reached, he can set the barbell down onto them without having to worry about being crushed by the heavy barbell. Absent the safety bars, a spotter would be required to assist the lifter to prevent serious injury or death when training to failure. However, many lifters prefer to train by themselves, or they do not have a consistent or trustworthy workout partner. Often, lifters find it difficult to find a long term training partner due to differences in life schedules, training goals, motivation levels, and consistency.

Lifters who train at a gym can ask others for a spot. However, often times people get annoyed when you ask them for a spot, since you are interrupting their workout and concentration. Thus, many lifters do not ask out of fear of bothering someone they do not know. Also, when setting a new personal record, often there is not always a strong enough person available who is able and willing to assist. Further, there is no guarantee that the spotter will perform the spot correctly. Inexperienced spotters often grab the bar prematurely when they see the lifter struggling to complete their final repetition, when in fact that lifter would have been able to complete the repetition without assistance. This often leads to frustration in a missed opportunity to train to failure, a missed chance to reach a desired goal, or to set a personal best. Thus, the preferred solution for many lifters is to use the cage. This allows the lifters to train to failure and get the most out of their lifting session, and to do so safety and consistently without having to rely on others.

Many Barbell Power Racks also come equipped with a "Pull Up Bar" which allows an individual lifter or a pair of lifters to perform both upper or lower body barbell exercises and Pull Up Bar upper body or abdominal (e.g., hanging leg raises) exercises all in the same apparatus. This also allows an individual lifter or a pair of lifters to "superset" various combinations of these exercises all in the same apparatus which allows them to meet the required few seconds rest between each exercise for optimal benefit. Without this, it would be frowned upon for a lifter or pair of lifters to tie up multiple pieces of equipment in a busy gym to complete several of these supersets.

In addition to the barbell, dumbbells are an equally important tool in the arsenal of the lifter who wishes to get stronger and/or sculpt his muscles. Dumbbells are better at keeping the muscles on each side of the body more equal in strength. They also allow a more free range of motion than the barbell on some exercises (e.g., chest press), which can be used to target the muscles in a unique fashion, as well as allow those with specific injuries to modify an exercise appropriately. The same issues discussed above for in which one desires to train to failure with a barbell without relying on a spotter, face those performing dumbbell lifting exercises.

U.S. Pat. No. 7,001,314 to Hummer discloses a weight-lifting apparatus for supporting dumbbells including side frames carrying at least one angularly adjustable dumbbell support. In one aspect, the dumbbell support is vertically adjustable on the side frames. In another aspect, the dumbbell support is mounted on a horizontal crossbar extending between and coupled to the elevation adjustable members on the side frames. The elevation adjustment members are motor or manually driven screws. In another aspect, the dumbbell support is movably mounted on the crossbar and latchable in horizontally adjustable positions along the crossbar.

However, Hummer is not a simple, non-mechanism, mechanical design that allows for heavy dumbbells. Hummer's horizontal crossbar does not have angle studs and corresponding angled slots in the side frames to allow for simple and fast pull out and slide in manual height adjustment and self-locking of the bar on the side frames from its own weight. Instead, in order to elevate the crossbar, Hummer uses complicated, expensive, dynamic hardware involving, motors, shafts, cranks, pulleys, and gears. To join the crossbar to the side frames Hummer uses latches and pins. All of the above mentioned complex, dynamic hardware of Hummer is more subject to wear, overuse, limited life, and excessive manufacturing, maintenance, repair and part replacement costs than a simple, non-mechanism design.

Additionally, Hummer's dumbbell supports are not angled vertically upward from horizontal to keep the dumbbells from rolling toward the lifter and to more advantageously share the load of the dumbbells between the dumbbell supports and side frames to allow the heaviest dumbbell to be used. Further, Hummer is not an easy to use design as it does not resemble the conventional barbell power rack with manually adjustable barbell shelves.

Finally, Hummer lacks the cage design and pull up bars a of Dumbbell Power Rack and lacks the cage design with both a dumbbell power rack and barbell power rack section along with pull up bars that a Dumbbell and Barbell Combo Power Rack has. Thus, Hummer does not allow for an individual lifter or pair of lifters to superset dumbbell and pull up bar exercises all in the same apparatus, or to superset dumbbell, barbell and pull up bar exercises all in the same apparatus.

U.S. Pat. No. 6,149,556 to Jordan discloses a multilevel dumbbell support apparatus having a base, a pair of front vertical supports and a pair of rear vertical supports, wherein the front vertical supports are connected to the rear vertical supports and all of the vertical supports are rigidly mounted to the base, thereby forming a single frame structure that is adapted for use with a weight lifting bench. The multilevel dumbbell support apparatus incorporates one or more dumbbell supports adjustably connected to the front vertical supports. Each dumbbell support comprises a front lip portion, a flat portion, and a rear inclined portion, wherein the front lip portion and the flat portion have an opening cut therein to accommodate a lifter's hand when grasping a dumbbell disposed thereon.

However, Jordan does not provide for width adjustment or angled lipless trays. A large and precise width adjustment is important to accommodate various size lifters as well as the starting and ending positions of the various available exercises. Angled, lipless trays allow for the safe return of the dumbbells by a fatigued lifter without danger of him bumping the lip of a conventional non-inclined tray with the dumbbells and losing control of them. The angle, rather than a lip keeps the dumbbells from later rolling toward the lifter. Also, the angle allows for a more advantageous sharing of the dumbbell weight between the dumbbell supports and the vertical supports.

SUMMARY OF THE INVENTION

The present invention provides, in at least one embodiment, a power rack apparatus for lifting dumbbells (e.g., Dumbbell Power Rack). The apparatus can have a conventional cage design or a novel cage design with dual pull up bars. The apparatus also has a novel horizontal support configured to attach to novel dumbbell trays. In another embodiment, in addition to the dumbbell power rack portion, the cage has a barbell power rack portion and the dual pull up bars (e.g., Dumbbell and Barbell Combo Power Rack).

An advantage of the present invention is, in addition to standing position dumbbell and barbell exercises, the cage design allows for conventional portable benches, which are common in most gyms, to be easily brought in to accommodate the various seated and lying position (flat, inclined and declined) versions of these exercises. Many conventional dumbbell tray systems require the user to purchase an expensive, specialized bench in order to interface with their dumbbell trays.

Another advantage of the present invention is that the caged design, along with the novel horizontal support design and novel dumbbell tray design allows the lifter to use significantly more weight than he could using a conventional dumbbell holder. Heaving heavy dumbbells off the floor or off the conventional dumbbell storage racks in the gym and into the starting position of an exercise is extremely dangerous and has led to countless injuries. The dumbbell trays are designed to hold small five pound dumbbells as well as giant 300 pound dumbbells. Many dumbbell racks use free standing stands or uprights that can be knocked over accidentally which is a safety concern when loaded with heavy dumbbells. Other dumbbell racks are dangerous in that they use ropes or cables to suspend the dumbbells. The very sturdy cage design is superior in this regard.

Another advantage of the invention is that the dumbbell trays are manually adjustable both horizontally and vertically. The non-mechanism, pull out and slide in horizontal support and dumbbell trays self-lock under their own weight to provide a simple, fast and robust method for setting the dumbbells at the correct height and width prior to a particular exercise. Often very short and/or narrow framed as well as very tall and/or wide framed weight lifters complain they cannot comfortably use most weight lifting apparatuses which are not designed for people of their size. The wide range of horizontal and vertical adjustments available from the cage design accommodates lifters from four feet tall to seven feet. This allows the lifters of virtually all sizes and dumbbell exercises to train to failure without a spotter. Further, the simple, non-mechanism design with no dynamic hardware (e.g., motors, pulleys, belts, cables, shafts, gears, springs, pins) that is more subject to wear, overuse, and limited life, eliminates excessive manufacturing, maintenance, repair and replacement parts costs associated with that hardware.

Another advantage of the cage design is that in the case of the Dumbbell Power Rack an individual lifter or a pair of lifters can superset dumbbell and pull up bar exercises all in the same apparatus, within the required few seconds of rest between each exercise, for optimal benefit. And in the case of the Dumbbell and Barbell Combo Power Rack, an individual lifter or a pair of lifters can superset dumbbell, barbell and pull up bar exercises all in the same apparatus. Both racks allow the commercial or home gym user to avoid the expense, as well as the loss of critical floor space necessary, to procure the multiple apparatuses needed to allow these exercises and superset scenarios.

A further advantage is the dumbbell trays shape and inclined angle from horizontal. The shape allows any standard shape dumbbell to be used (e.g., round, hexagon, and square), whereas many dumbbell racks only accommodate one particular shape of dumbbell. The angled, lipless trays allow for the safe return of the dumbbells by a fatigued lifter without danger of him bumping the lip of a conventional non-inclined tray with the dumbbells and losing control of them. The angle, rather than a lip, keeps the dumbbells from later rolling toward the lifter. Also, the angle allows for a more advantageous sharing of the dumbbell weight between the dumbbell supports and the vertical supports, allowing the use of much heavier dumbbells.

The foregoing, and other features and advantages of the invention, will be apparent from the following, more particular description of the preferred embodiments of the invention, the accompanying drawings, and the claims.

BRIEF DESCRIPTION OF THE DRAWINGS

For a more complete understanding of the present invention, and the advantages thereof, reference is now made to the ensuing descriptions taken in connection with the accompanying drawings briefly described as follows.

DETAILED DESCRIPTION OF EMBODIMENTS

Figure 1:
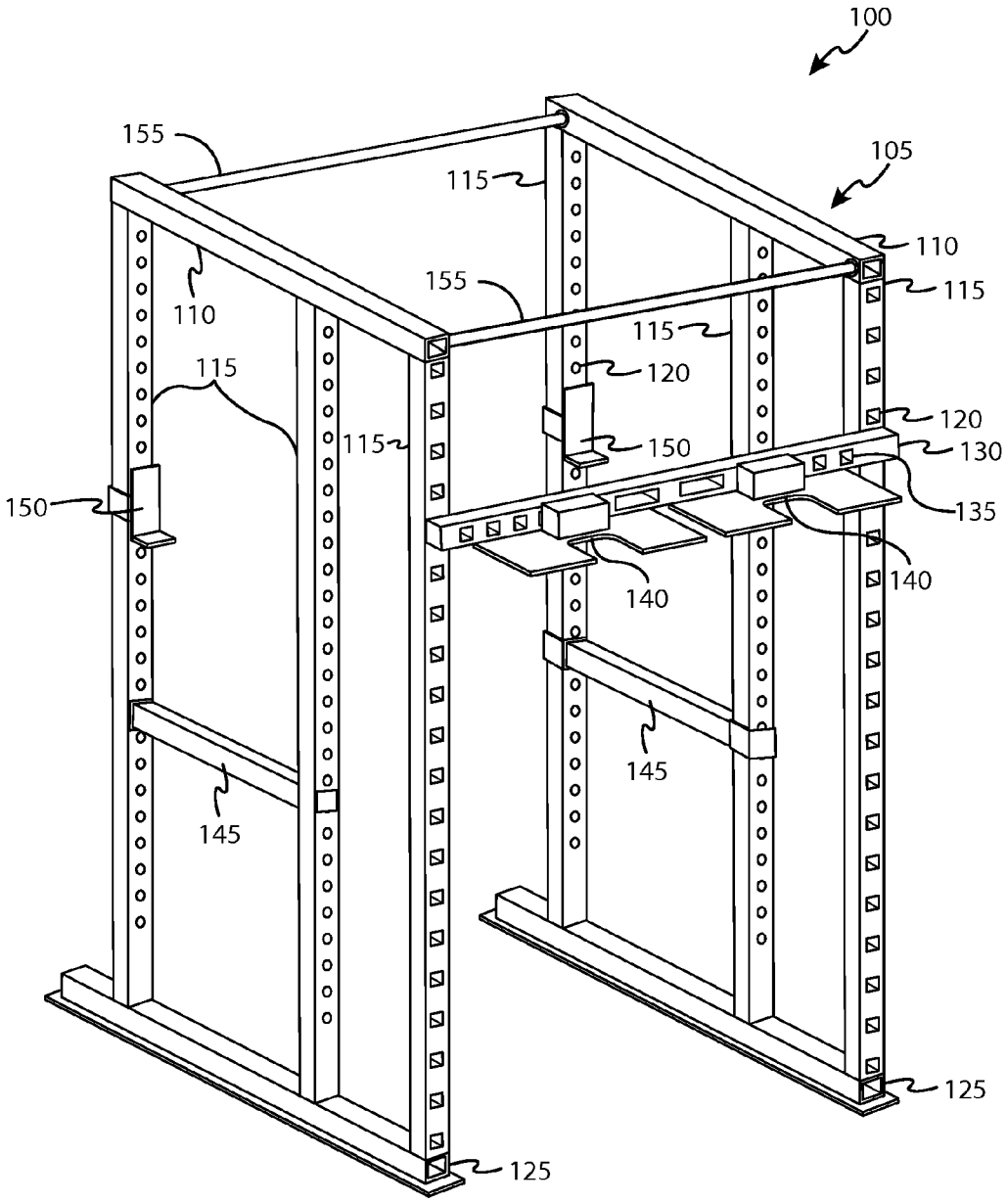
FIG. 1 illustrates a combo power rack apparatus for both dumbbells and barbells according to an embodiment of the invention.

Further features and advantages of the invention, as well as the structure and operation of various embodiments of the invention, are described in detail below with reference to the accompanying FIGS. 1-8, wherein like reference numerals refer to like elements. Although the illustrations show a dual pull up bar cage design, the apparatus can also be used with a conventional cage without the dual pull up bars or with only a single pull up bar.

The present invention provides, in at least one embodiment, a power rack apparatus for lifting dumbbells. The apparatus can have a conventional cage design or a novel cage design with dual pull up bars. The apparatus also has a novel horizontal support configured to attach to novel dumbbell trays. The horizontal support is configured to attach to the cage and the horizontal support contains a plurality of slots for horizontal width adjustment. The slots on the horizontal support are configured to receive a plurality of inclined dumbbell trays. The apparatus can be a combo power rack configured to hold barbells and dumbbells or a simplified power rack apparatus configured to just hold dumbbells.

Applicant supplies the following definitions. A Repetition (or "Rep") is one complete movement of a single exercise or lift. A set is a group of consecutive repetitions. Intensity is the level of demand that a given activity or exercise places on the body. A superset is when two or more different exercises are performed back to back with zero to just a few seconds rest between exercises (just long enough to enable the lifter to finish the first exercise and quickly begin the second one). "Training to Failure" is when the lifter continues their set of a given exercise until the muscles become so exhausted that despite their greatest effort, they cannot complete another full rep with controlled form. A spotter is a person who assists lifter with getting heavy dumbbell or barbell weights into the starting position and then closely monitors the lift in case assistance is needed to help place the weight back down safely once failure is reached.

FIG. 1 illustrates a combo power rack apparatus 100 for both dumbbells and barbells according to an embodiment of the invention. The apparatus 100 includes a cage 105, top supports 110, vertical supports 115 having slots 120 which are rectangular in the front two members and circular slots in the others, base supports 125, a horizontal support 130 having rectangular slots 135, dumbbell trays 140, barbell safety bars 145, barbell shelves 150, and pull up bars 155. For lifters who want both a dumbbell and barbell power rack, the combo power rack 100 saves expense and space, compared to having to acquire a separate dumbbell tray system and a conventional barbell power rack.

The apparatus 100 provides a powerful cage structure with inclined dumbbell trays 140 that are mechanically adjustable in both height and width. The apparatus 100 can advantageously use a cage structure already found in most weight lifting gyms or use a cage structure having a dual pull up bar design. The apparatus 100 allows for two lifters to work in different parts of the rack simultaneously involving dumbbell, barbell, and pull up bar exercises. The rack also allows both an individual lifter or a pair of lifters to superset exercises involving dumbbells, barbells, and pull up bar exercises. These supersets can be accomplished within the required few seconds of rest between exercises for optimal benefit. Without this rack, multiple pieces of equipment would have to be tied up at once, which is frowned upon in a busy gym. The conventional cage is already configured to receive the horizontal support 130 with attached dumbbell trays 140.

The apparatus 100 is designed to be used with the lifter facing towards the dumbbell trays 140, which is the safest position for racking and un-racking the dumbbells. Dumbbell trays that have the lifter facing away from the tray have inherent safety issues such as the dumbbells sometimes not being placed entirely on the trays which could cause them to fall off. In addition, high stress is placed on the shoulder's rotator cuffs as the lifter's arms are rotated backwards to rack the weight, rather in the safer forward direction.

The apparatus 100 is advantageously fast to set up with the simple insertion of equipment. Fast set-up is important in weight lifting, because if a lifter spends too much time setting up a piece of equipment, he may avoid using that equipment in the future, as set-up time eats into the limited time allocated for the workout.

Further, the apparatus 100 is advantageously simple to use, manufacture and maintain. A simple design is important, as complex machines often intimidate many lifters from trying to understand how to use the machine and require expensive repair and maintenance. The apparatus 100 has no complex or dynamic moving hardware or mechanisms such as screws, clamps, knobs, levers, cables, belts, cranks, foot pedals, control units, motors, pistons, bearings, shafts, bushings, etc. Dynamic parts are much more subject to wear, overuse, failure, or limited life and lead to excessive manufacturing, maintenance, repair and part replacement costs.

The cage 105 (e.g., a power rack) can be a conventional cage which is conveniently a common staple of weight lifting gyms or the cage 105 can have a unique dual pull up bar design with the pull up bars 155 for supersets. The cage 105 includes the top supports 110, the vertical supports 115, and the base supports 125. The cage 105 provides a powerful structure that can support heavy weights for power lifting exercises.

Although the vertical supports 115 are shown with a particular number of slots 120, the vertical supports 115 can have more or less slots in order to have more precise height control or to extend over a further or lesser range.

The horizontal support 130 (e.g., height adjustment bar, frame, etc.) is attachable to the cage 105. Attaching the horizontal support 130 to the cage 105 is a key distinguishing feature from many dumbbell trays. The cage 105 provides a powerful structure which allows for heavier dumbbells to be used. Also, the cage 105 already exists in weight lifting gyms and allows for vertical adjustment.

The horizontal support 130 attaches to the slots 120 of the vertical supports 115. The horizontal support 130 is height adjustable such that the dumbbell trays 140 can be positioned at the right height for a particular lift and lifter. In one embodiment, the horizontal support 130 is above the lifter's shoulders (e.g., for dumbbell military press). This high height is not feasible with many conventional dumbbell trays due to instability at that height. The apparatus 100 uses the powerful structure from the cage 105 to provide mechanical stability at high heights. In another embodiment, the horizontal support 130 is positioned below the lifter's knees (e.g., for bent over rows).

The slots 135 (e.g., frame slots) of the horizontal support 130 allow for novel mechanical width adjustment of the dumbbell trays 140. In one embodiment, the dumbbell trays 140 are positioned wide (e.g., for a wide framed lifter performing wide grip dumbbell bench press). This wide width for heavy dumbbells is not feasible with conventional dumbbell trays because they lack the width adjustment range and strength that the power cage structure has. In another embodiment, the dumbbell trays 140 are positioned close (e.g., for a narrow framed lifter performing close grip dumbbell touching curls). This adjustable width, with non-dynamic (e.g., moving) hardware or mechanisms, is ideal for a simplified, powerful, long lasting structure. Although the slots 135 are illustrated as being a combination of circular and rectangular, the slots are purely circular or rectangular in another embodiment. In a further embodiment, only the front vertical support 115 has slots 120, such as in an embodiment without a barbell (i.e., a dumbbell only embodiment).

The dumbbell trays 140 are configured to hold any shaped dumbbell (e.g., circular, hexagon, etc.). The dumbbell trays include two flat portions to hold the dumbbells and an attachment portion (e.g., a stud and stud block) to attach to the horizontal support 130.

Further, the inclined angle of the dumbbell trays 140 allow the gravitational force of the dumbbell to be more advantageously shared between the cage 105, the horizontal support 130 and the dumbbell trays 140. This allows strong lifters to use dumbbells that were previously too heavy for conventional horizontal trays with lips. The dumbbell trays 140, attached to the horizontal support 130, is discussed further in FIGS. 3-4, and referred to as device 300.

A key advantage of the dumbbell trays 140 is that they allow a lifter to train to failure by allowing the lifter to lower the dumbbell onto the dumbbell trays 140 after reaching failure. Training to failure is a highly effective way to get the most benefit out of a given set of a particular exercise.

Another advantage of the dumbbell trays 140 is they allow the lifter to maximize the effect of the lift. The lifter can load the dumbbell onto the dumbbell tray in the starting position using two hands, as opposed to one hand. Getting the dumbbells to the starting position taps into the strength that the lifter has available for the actual set itself and is an injury risk with heavy dumbbells. Also, the dumbbell trays 140 allow the lifter to rest prior to the set, allowing the lifter to be better mentally and physically ready for the lift. Just as important, the dumbbell trays 140 allow the lifter to rest the dumbbells at the ending position after the lift, when the lifter's muscles have been trained to failure. Returning the dumbbells to a rack or the floor after the exercise is just as dangerous as getting the dumbbells into the starting position at the beginning of a set. When the lifter has recovered, the lifter can use two arms to move each dumbbell back to the floor or rack. Without the dumbbell trays, lifters often drop the heavy dumbbells after completing their set, which can damage the gym floor, distract other lifters with the noise, or bounce and strike one of the lifters in the gym.

The barbell safety bars 145 (e.g., safety bars) are a conventional part of the combo dumbbell and barbell power rack apparatus 100 and are known by those with skill in the art. The safety bars 145 are horizontal, can be adjusted vertically, and allow barbell lifters to train to failure, without a human spotter.

The barbell shelves 150 (e.g., barbell holders) are a conventional piece of a cage, the purposes of which are known by those with skill in the art. The shelves 150 are typically in a "J hook" design and placed at the desired height based on the lifter's body size and the particular exercise being performed.

The pull up bars 155 (e.g., dual pull up bars) allow the cage 105 to provide additional functionality (e.g., pull ups, abdominal hanging leg raises, etc.) while not damaging the powerful structure of the cage 105. Many conventional power racks come equipped with a single pull up bar for performing upper body pull up exercises and hanging abdominal stomach exercises. However, two pull up bars allow a pair of lifters to simultaneously perform pull ups, or allow one lifter to perform pull ups while another lifter uses the dumbbell trays 140, or the barbell power rack portion, in the case of the combo rack. Also, the pull up bars allow supersets of various combinations of dumbbell, barbell and pull up bar exercises to be performed within the required few seconds between each exercise for optimal benefit. The dual pull up bars 155 allow for significant versatility compared to a conventional cage.

Figure 2:
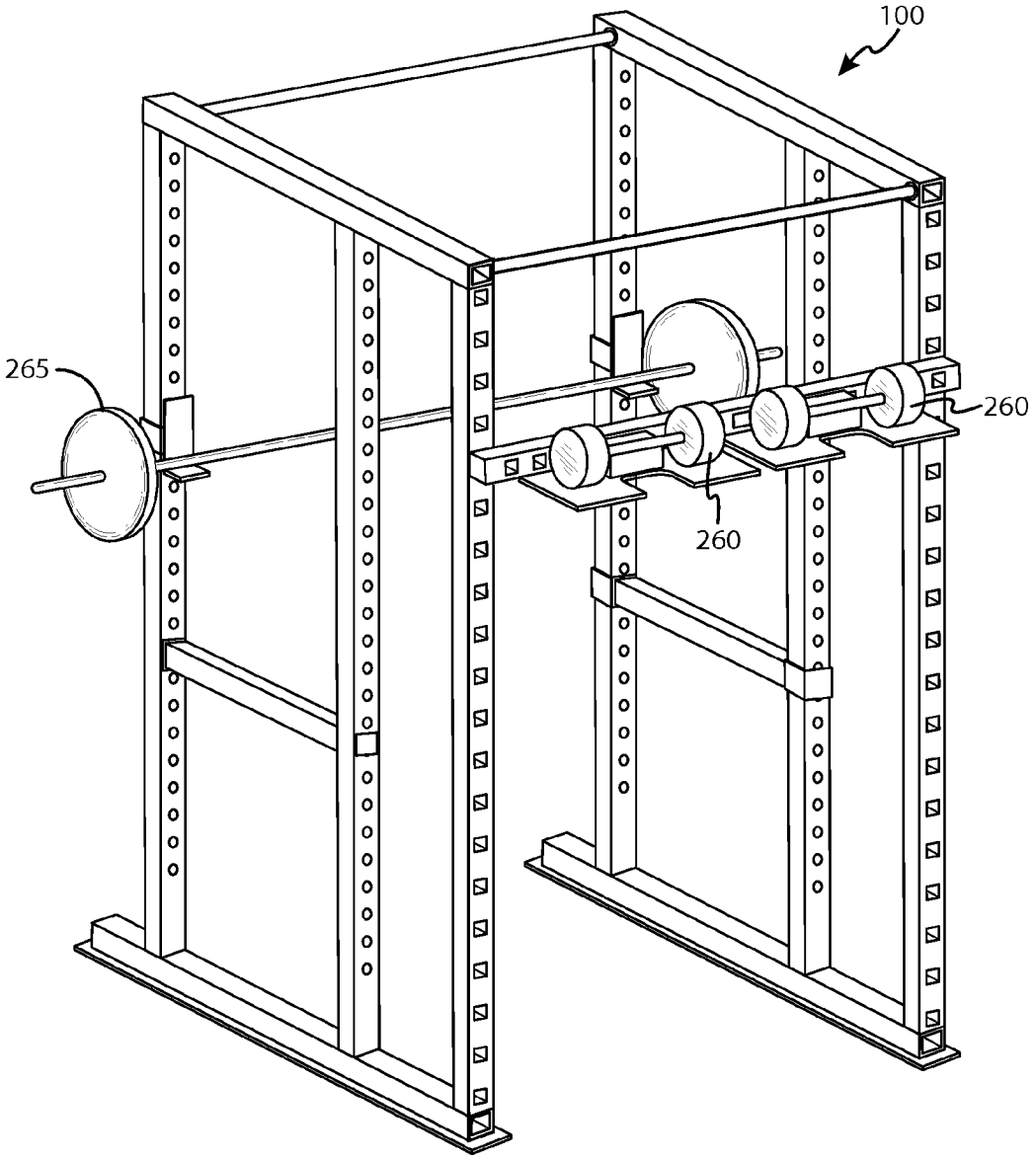
FIG. 2 illustrates the combo power rack apparatus with weights according to an embodiment of the invention.

FIG. 2 illustrates the power rack apparatus 100 with weights according to an embodiment of the invention. A dumbbell 260 rests on the dumbbell tray 140 with the weight spread between the dumbbell tray 140, the horizontal support 130, and the vertical support 115 of the cage 105. The dumbbell 260 can be any conventional type of dumbbell (e.g., round, hexagon, square, etc.). The ability to hold heavy dumbbells is critical as power lifters and bodybuilders need to be able to use very heavy dumbbells for exercises like dumbbell shoulder shrugs, dumbbell dead lifts, dumbbell squats, and dumbbell lunges. The dumbbell trays are also versatile enough to accommodate lighter dumbbells such that lifters who are not as strong or are recovering from injury can still perform these exercises. The barbell 265 with weights rests on the barbell shelf 150. The barbell 265 can be any conventional type of barbell (e.g., 45 pound "Olympic style" bar with 45 pound plates shown).

Figure 3:
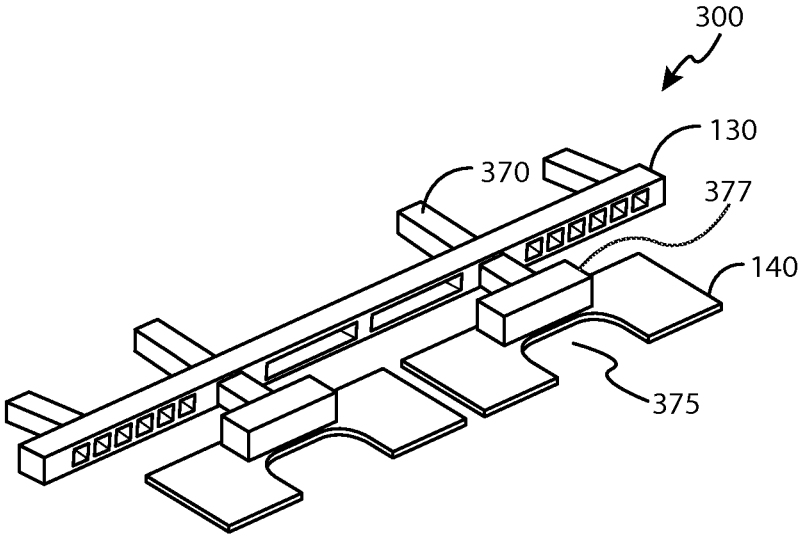
FIG. 3 illustrates a top view of a device of the power rack apparatus according to an embodiment of the invention.

FIG. 3 illustrates a top view of a device 300 of the power rack apparatus 100 according to an embodiment of the invention. The device 300 is defined as the horizontal support 130, to which one or more dumbbell trays 140 are attached.

The novel dumbbell trays 140 each have a downward angled rectangular stud 370 that is permanently fixed to a stud block 377. The stud block 377 is permanently fixed to the top center of the dumbbell tray 140. The stud 370 is configured to extend through any one of the angled rectangular slots 135 of the horizontal support 130 in a simple slide in or pull out motion. Once the angled studs 370 are inserted, they self-lock and the dumbbell tray 140 cannot fall out due to the angle of insertion and the weight of the dumbbell tray 140.

Also, due to the novel rectangular shape of the studs 370, the dumbbell tray 140 also self-locks in the pivoting or rotation direction once inserted. The dumbbell trays 140 also have a cutout 375 which makes it easier for the lifter to grab the dumbbell, which is especially useful when the dumbbell trays 140 are above the lifter's chest (e.g., for a military press). The cutout 375 is configured to allow a lifter's hand to pass through it.

Figure 4:
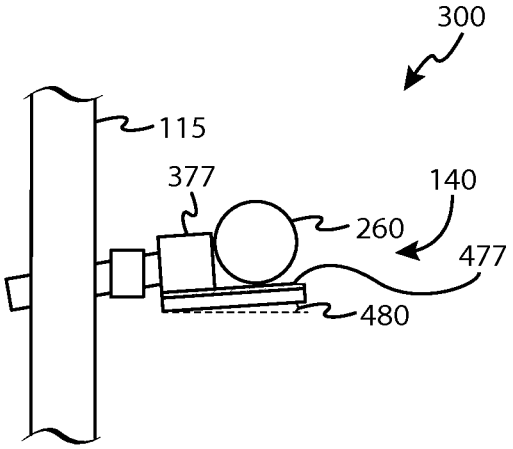
FIG. 4 illustrates a side view of the device of the power rack apparatus according to an embodiment of the invention.

FIG. 4 illustrates a side view of the device 300 of the power rack apparatus 100 according to an embodiment of the invention. FIG. 4 highlights the inclined angle 480 discussed above with respect to FIG. 1. The inclined angle 480 is a safety device for returning the weights, which is ideal when sets are taken to failure and heavier dumbbells are used. Further, the inclined angle 480 spreads the gravitational force of the dumbbell more advantageously between the dumbbell trays 140, the horizontal support 130 and the vertical supports 115. The dumbbell trays has a shock absorbing material 477 on the top surfaces to manage impact forces from dumbbells accidently dropped, instead of placed in a controlled manner.

After the dumbbell trays 140 are attached to the horizontal support 130, they are at a novel inclined angle from horizontal. The inclined angled provides a safety feature that prevents all conventional dumbbell shapes from rolling off toward the lifter. A conventional dumbbell tray is not inclined, so it includes a lip to prevent the dumbbell from rolling off, but this presents a safety issue as an exhausted lifter may bump the dumbbells into the lip when returning the dumbbells after a set and lose control of them.

In one embodiment, the inclined angle 480 is slightly greater than horizontal at three degrees. Having an inclined angle only slightly greater than horizontal acts as a safety feature that prevents the dumbbells from rolling toward the lifter, while still being close enough to horizontal that a fatigued lifter can easily load the dumbbells onto the dumbbell trays 140. The design does not need a lip, which is a potential safety issue, as discussed earlier. In another embodiment, the inclined angle is up to 10 to 15 degrees. This inclined angle allows the cage to support more of the weight of the heavier dumbbells. Although the apparatus is illustrated having flat trays, the apparatus can include other non-flat forms while still maintaining the inclined upward angle.

Figure 5:
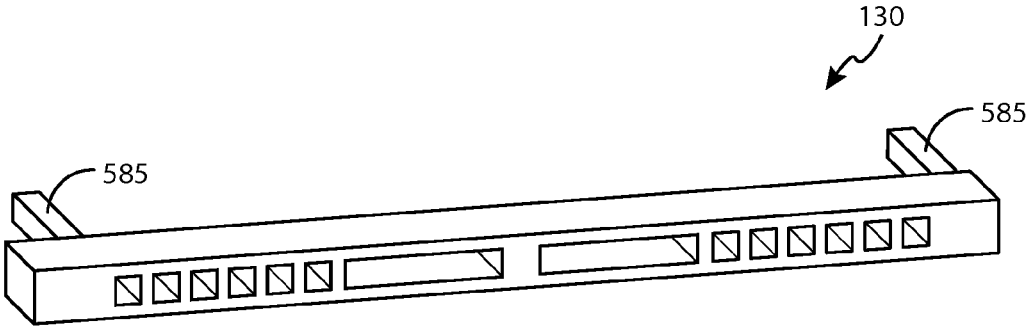
FIG. 5 illustrates a horizontal support of the power rack apparatus according to an embodiment of the invention.

FIG. 5 illustrates the horizontal support 130 of the power rack apparatus 100 according to an embodiment of the invention. FIG. 5 shows the horizontal support 130 without the dumbbell trays 140 attached.

The novel horizontal support 130 has downward angled rectangular studs 585 (e.g., self-locking studs) that are configured to extend through any of the angled rectangular slots 120 of the vertical supports 115 in a simple slide in or pull out motion. Once the angled studs 585 are inserted, they self-lock and the horizontal support 130 cannot fall out due to the angle of insertion and the weight of the horizontal support 130.

Also, due to the novel rectangular shape of the studs 585, the horizontal support 130 also self-locks in the pivoting or rotation direction once inserted. Although the horizontal support 130 is shown with a particular number of slots, the horizontal support 130 can have more or less slots in order to have more precise width control or to extend over a further or lesser range.

Figure 6:
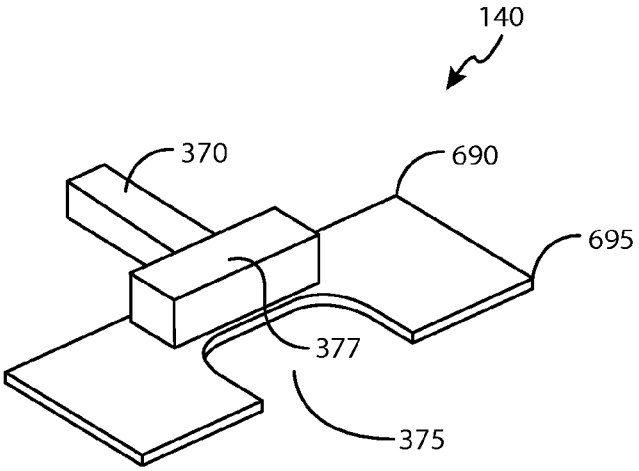
FIG. 6 illustrates a dumbbell tray of the power rack apparatus according to an embodiment of the invention.

FIG. 6 illustrates one of the dumbbell trays 140 of the power rack apparatus 100 according to an embodiment of the invention. FIG. 6 shows the dumbbell tray 140 without being attached to the horizontal support 130.

The dumbbell tray 140 includes the angled stud 370, the stud block 377, a proximal end 690, and a distal end 695. The distal end 695 is higher than the proximal end 690 such that the dumbbell tray 140 is angled upward with respect to the horizontal support 130. The angled stud 370 (e.g., self-locking stud) inserts into one of the slots 135 of the horizontal support 130. Like the angled studs 585 discussed above with respect to FIG. 5, the angled stud 370 is unique in that the angle allows for self-locking into the horizontal support 130 and a rectangular design prevents pivoting of the dumbbell tray 140.

Figure 7:
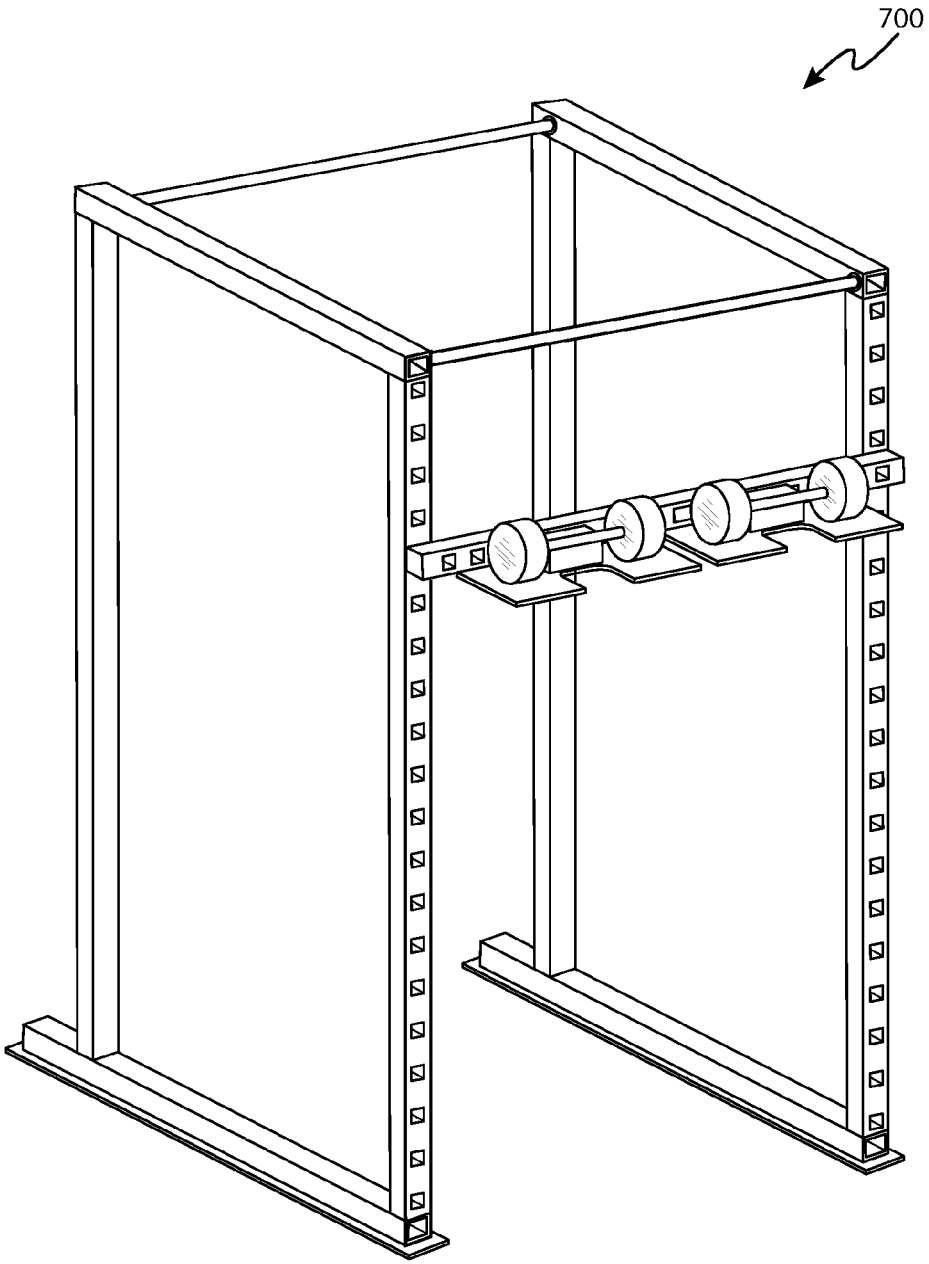
FIG. 7 illustrates a simplified power rack apparatus for dumbbells according to an embodiment of the invention.

FIG. 7 illustrates a simplified power rack apparatus 700 for dumbbells according to an embodiment of the invention. Compared to the apparatus 100 which is a combo dumbbell and barbell power rack, the apparatus 700 is only for dumbbells and pull up bar exercises. The apparatus 700 lacks two of the vertical supports 115, the barbell shelves 150, and barbell safety bars 145 associated with the apparatus 100. The apparatus 700 has the same functionality as the apparatus 100 minus the barbell power rack portion. The apparatus 700 allows for two lifters to work in different parts of the rack simultaneously involving dumbbell and pull up bar exercises. The rack also allows an individual lifter, or a pair of lifters, to "superset" exercises involving dumbbell and pull up bar exercises.

The apparatus 700 is advantageously smaller, lighter, and more portable. In one embodiment, the apparatus 700 (e.g., dumbbell only power rack) occupies a foot print of approximately four feet wide by four feet deep, whereas the apparatus 100 (e.g., combo dumbbell and barbell power rack) occupies a foot print of approximately four feet wide by six feet deep. The apparatus 700 is ideal for lifters who only perform dumbbell exercises, lifters who do not have the extra floor space required for the apparatus 100, and lifters who currently already own a barbell power rack and do not want to spend the extra money required for the combo dumbbell and barbell power rack apparatus 100. For lifters who want both a dumbbell and barbell power rack, the combo power rack 100 saves space compared to having a separate dumbbell tray and barbell power rack.

Like the apparatus 100, the apparatus 700 can be used to perform complete full range of motion training, partial repetitions, and static holds. Similarly, the apparatus 700 allows for versatility of the type of exercise positions (e.g., standing, seated, lying, etc.). Like apparatus 100, portable benches, common in most gyms, can easily be brought into the apparatus 700 to accommodate the seated and lying exercises. Some conventional dumbbell tray systems require their own expensive, specialized bench be used in order to interface with the dumbbell trays.

The apparatus 700 allows the lifter to perform many exercises, including different types of dumbbell bench presses, overhead dumbbell presses, dumbbell rows, dumbbell shrugs, dumbbell tricep extensions, dumbbell curls, dumbbell squats, dumbbell dead lifts and pull up bar exercises. The apparatus 700 also allows two lifters to work in different parts of the rack simultaneously involving Dumbbell and Pull up bar exercises. The rack also allows an individual lifter, or a pair of lifters, to "superset" many different exercises combinations involving dumbbells and pull up bar exercises.

Figure 8:
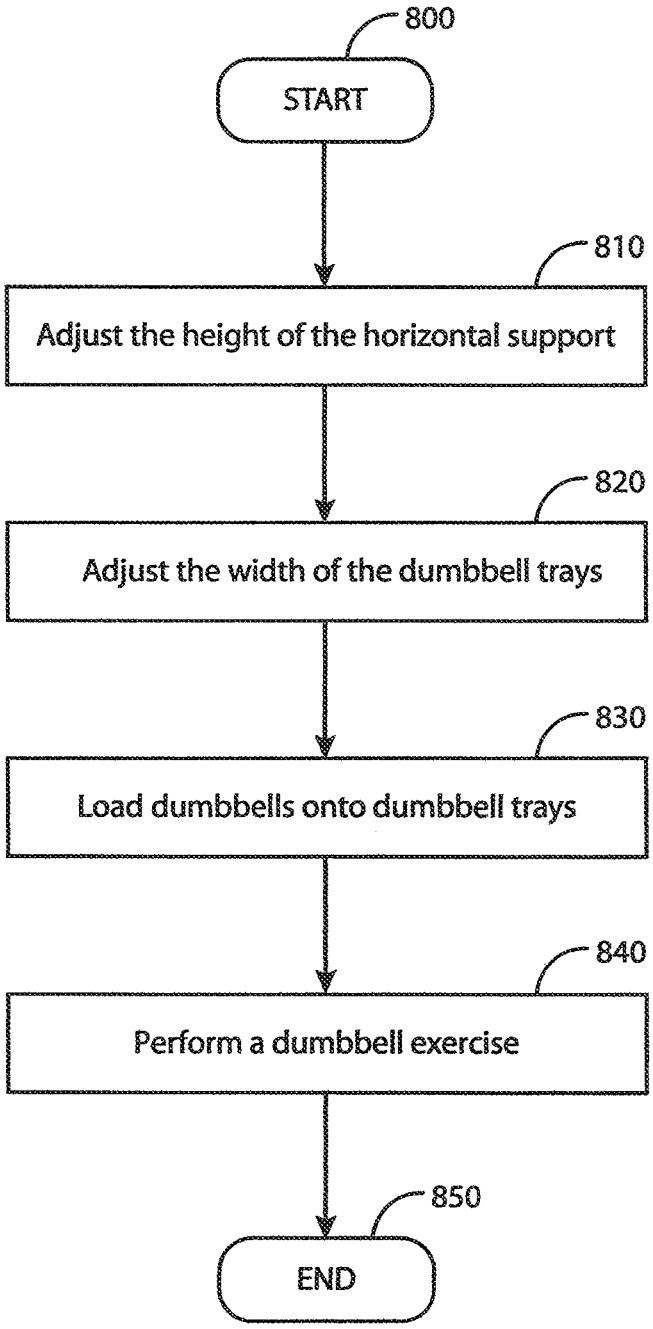
FIG. 8 illustrates the process of using the dumbbell trays according to an embodiment of the invention.

FIG. 8 illustrates the process of using the dumbbell trays 140 according to an embodiment of the invention. The process starts at step 800. At step 810, a lifter adjusts the height of the horizontal support 130. The height based on the lifters size and type of exercise he is performing, corresponds with the height which the lifter wishes to have the dumbbells before and after the exercise such that the weights can be lowered safely onto the dumbbell trays 140 after lifting to failure. The lifter inserts the angled studs 585 into the slots 120 of the cage 105.

At step 820, the lifter mechanically adjusts the width of the dumbbell trays 140. The lifter accomplishes this by inserting the angled studs 370 of the dumbbell trays 140 into the desired slots 135 in the horizontal support 130. The horizontally spaced slots 135 in the horizontal support 130 allow the lifter to select the desired width corresponding to the width which the lifter wishes to have the dumbbells before and after the exercise.

The lifter will typically load the dumbbells onto the dumbbell trays 140 at step 830 one at a time, reducing the risk of injury and giving the lifter time to rest prior to starting a set. At step 840, after the lifter is fully rested from loading the dumbbells, the lifter performs a dumbbell exercise and returns the dumbbells to the dumbbell trays 140. The process may be repeated recursively a number of times and ends at step 850.

It is to be recognized that depending on the embodiment, certain acts or events of any of the methods described herein can be performed in a different sequence, may be added, merged, or left out altogether (for example, not all described acts or events are necessary for the practice of the method). Moreover, in certain embodiments, acts or events may be performed concurrently, rather than sequentially.

The invention has been described herein using specific embodiments for the purposes of illustration only. It will be readily apparent to one of ordinary skill in the art, however, that the principles of the invention can be embodied in other ways. Therefore, the invention should not be regarded as being limited in scope to the specific embodiments disclosed herein, but instead as being fully commensurate in scope with the following claims.

What is claimed is:

1. A weight training apparatus comprising:

a cage comprising four vertical support posts, a top support, and a base support, wherein the four vertical support posts comprise a first vertical support post and a second vertical support post, the first vertical support post and the second vertical support post each comprise a plurality of slots angled upward with respect to the horizontal, with an angle being less than 90 degrees;

a one-piece, fully detachable horizontal support having a first end and a second end, the first end comprising a permanently fixed stud angled downward with respect to the horizontal, with an angle being less than 90 degrees, the second end comprising a permanently fixed stud angled downward with respect to the horizontal, with an angle being less than 90 degrees, wherein the stud of the first end is detachably coupled to a slot of the first vertical support post and the stud of the second end is detachably coupled to a slot of the second vertical support post, wherein the horizontal support comprises a plurality of slots angled upward with respect to the horizontal, with an angle being less than 90 degrees, wherein the horizontal support comprises a rectangular bar between the first end and the second end, the rectangular bar comprising a face surface in a vertical plane and a back surface in a vertical plane, the plurality of upward angled slots extend through the face surface and the back surface, and wherein the horizontal support can be fully removed from the first and second vertical support slots during a vertical adjustment along the first and second vertical support posts by detaching the horizontal support from the first and second vertical support posts before reinserting the studs of the horizontal support into the first and second vertical support posts at a new desired location at which the horizontal support will self-lock under its own weight without the use of a pin; and one or more one-piece fully, detachable dumbbell trays wherein each dumbbell tray comprises a permanently fixed stud angled downward with respect to the horizontal, with an angle being less than 90 degrees, wherein the stud is detachably coupled to any one of the plurality of slots of the horizontal support, wherein each dumbbell tray can be fully removed from the horizontal support slots during a horizontal adjustment along the horizontal support by detaching the dumbbell tray from the horizontal support before reinserting the stud of the dumbbell tray into the horizontal support slot at a new desired location at which the dumbbell tray will self-lock under its own weight without the use of a pin, wherein the dumbbell trays are angled upward with respect to the horizontal support, with an angle being less than 90 degrees.

2. The weight training apparatus of claim 1, wherein the dumbbell trays are straight from a proximal end to a distal end.

3. The weight training apparatus of claim 1, wherein the downward angled studs of the horizontal support are rectangular.

4. The weight training apparatus of claim 1, wherein the downward angled studs of the one or more dumbbell trays are rectangular, wherein the one or more dumbbell trays each comprise a stud block attached to the angled stud.

5. The weight training apparatus of claim 1, wherein the cage comprises single or dual pull up bars.

6. The weight training apparatus of claim 1, wherein the cage comprises two barbell shelves.

7. The weight training apparatus of claim 1, wherein the cage comprises two barbell safety bars.

8. The weight training apparatus of claim 1, wherein the one or more dumbbell trays each comprise a cutout in a distal end.

9. The weight training apparatus of claim 1, wherein the one or more dumbbell trays each comprise a shock absorbing material.

10. The weight training apparatus of claim 1, wherein the plurality of upward angled slots of the first vertical support post and second vertical support post are rectangular.

11. The weight training apparatus of claim 1, wherein the plurality of upward angled slots of the horizontal support are rectangular.

12. A weight training apparatus comprising:

a vertical support comprising two vertical support posts including a plurality of slots angled upward with respect to the horizontal, with an angle being less than 90 degrees, and disposed along each vertical support post;

a one-piece, fully detachable horizontal support having a first end and a second end, the first end comprising a permanently fixed stud angled downward with respect to the horizontal, with an angle being less than 90 degrees, the second end comprising a permanently fixed stud angled downward with respect to the horizontal, with an angle being less than 90 degrees, wherein the stud of the first end is detachably coupled to a slot of the first vertical support post and the stud of the second end is detachably coupled to a slot of the second vertical support post, wherein the horizontal support comprises a plurality of slots angled upward with respect to the horizontal, with an angle being less than 90 degrees, wherein the horizontal support comprises a rectangular bar between the first end and the second end, the rectangular bar comprising a face surface in a vertical plane and a back surface in a vertical plane, the plurality of upward angled slots extend through the face surface and the back surface, and wherein the horizontal support can be fully removed from the first and second vertical support slots during a vertical adjustment along the first and second vertical support posts by detaching the horizontal support from the first and second vertical support posts before reinserting the studs of the horizontal support into the first and second vertical support posts at a new desired location at which the horizontal support will self-lock under its own weight without the use of a pin; and one or more one piece fully, detachable dumbbell trays wherein each dumbbell tray comprises a permanently fixed stud angled downward with respect to the horizontal, with an angle being less than 90 degrees, wherein the stud is detachably coupled to any one of the plurality of slots of the horizontal support, wherein each dumbbell tray can be fully removed from the horizontal support slots during a horizontal adjustment along the horizontal support by detaching the dumbbell tray from the horizontal support before reinserting the stud of the dumbbell tray into the horizontal support slot at a new desired location at which the dumbbell tray will self-lock under its own weight without the use of a pin, wherein the dumbbell trays are angled upward with respect to the horizontal support, with an angle being less than 90 degrees.

13. The weight training apparatus of claim 12, wherein the dumbbell trays are straight from a proximal end to a distal end.

14. The weight training apparatus of claim 12, wherein the downward angled studs of the horizontal support are rectangular.

15. The weight training apparatus of claim 12, wherein the downward angled studs of the one or more dumbbell trays are rectangular, wherein the one or more dumbbell trays each comprise a stud block attached to the angled stud.

16. The weight training apparatus of claim 12, wherein the plurality of upward angled slots of the two vertical support posts are rectangular.

17. The weight training apparatus of claim 12, wherein the plurality of upward angled slots of the horizontal support are rectangular.

18. A weight training device comprising:

a one-piece, fully detachable horizontal support having a first end and a second end, comprising permanently fixed-studs angled downward with respect to the horizontal, with an angle being less than 90 degrees, wherein the studs are detachably coupled to a plurality of slots of a vertical support, with the plurality of slots of the vertical support angled upward with respect to the horizontal, with an angle being less than 90 degrees, wherein the horizontal support comprises a plurality of slots angled upward with respect to the horizontal, with an angle being less than 90 degrees, wherein the horizontal support comprises a rectangular bar between the first end and the second end, the rectangular bar comprising a face surface in a vertical plane and a back surface in a vertical plane, the plurality of upward angled slots extend through the face surface and the back surface, and wherein the horizontal support can be fully removed from the vertical support slots during a vertical adjustment along the plurality of upward angled slots of the vertical support by detaching the horizontal support from the vertical support, before reinserting the studs of the horizontal support into the vertical support at a new desired location at which the horizontal support will self-lock under its own weight without the use of a pin; and one or more one-piece fully, detachable dumbbell trays, wherein each dumbbell tray comprises a permanently fixed-stud angled downward with respect to the horizontal, with an angle being less than 90 degrees, wherein the stud is detachably coupled to any one of the plurality of slots of the horizontal support, wherein each dumbbell tray can be fully removed from the horizontal support slots during a horizontal adjustment along the horizontal support by detaching the dumbbell tray from the horizontal support before reinserting the stud of the dumbbell tray into the horizontal support slot at a new desired location at which the dumbbell tray will self-lock under its own weight without the use of a pin, wherein the dumbbell trays are angled upward with respect to the horizontal support, with an angle being less than 90 degrees.

19. The weight training device of claim 18, wherein the dumbbell trays are straight from a proximal end to a distal end.

* * * * *